US010830490B2

(12) United States Patent
Rokade et al.

(10) Patent No.: US 10,830,490 B2
(45) Date of Patent: Nov. 10, 2020

(54) LIQUID DRAINAGE SYSTEMS AND METHODS

(71) Applicant: Johnson Controls Technology Company, Auburn Hills, MI (US)

(72) Inventors: Dnyaneshwar G. Rokade, Pune (IN); Sriram Ramanujam, Pune (IN); Karan Garg, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 193 days.

(21) Appl. No.: 16/102,513

(22) Filed: Aug. 13, 2018

(65) Prior Publication Data

US 2020/0041166 A1 Feb. 6, 2020

Related U.S. Application Data

(60) Provisional application No. 62/713,315, filed on Aug. 1, 2018.

(51) Int. Cl.

| | |
|---|---|
| ***F24F 13/22*** | (2006.01) |
| *B65D 21/08* | (2006.01) |
| *F25D 21/14* | (2006.01) |

(52) U.S. Cl.

CPC ..... *F24F 13/222* (2013.01); *B65D 21/086* (2013.01); *F24F 2013/227* (2013.01); *F25D 21/14* (2013.01)

(58) Field of Classification Search

CPC ..... B65D 21/086; F24F 13/222; F24F 2013/227; F25D 21/14

See application file for complete search history.

(56) References Cited

U.S. PATENT DOCUMENTS

| | | | | |
|---|---|---|---|---|
| 3,306,070 A * | 2/1967 | Herb | F24F 13/20 | 62/285 |
| 4,088,466 A * | 5/1978 | Humphrey | F24F 13/22 | 62/286 |
| 4,907,420 A * | 3/1990 | Mahanay | F24F 13/222 | 62/285 |

(Continued)

FOREIGN PATENT DOCUMENTS

| | | |
|---|---|---|
| EP | 1507123 A2 | 2/2005 |
| EP | 2722609 A1 | 4/2014 |
| WO | 2008084277 A1 | 7/2008 |

*Primary Examiner* — Frantz F Jules
*Assistant Examiner* — Lionel Nouketcha
(74) *Attorney, Agent, or Firm* — Fletcher Yoder, P.C.

(57) ABSTRACT

The present disclosure relates to a liquid drainage system for a heating, ventilation, and/or air conditioning (HVAC) system, where the liquid drainage system includes a drain pan configured to collect and drain condensate within a housing. The drain pan is configured to be mounted within the housing separate from an evaporator assembly and is removable from the housing independent of the evaporator assembly. The liquid drainage system also includes a drain pan extension plate configured to collect and drain condensate to the drain pan, where the drain pan extension plate is configured be removably mounted within the housing. The drain pan extension plate and the drain pan are configured to overlap with one another, in an assembled configuration, along a direction of airflow across the evaporator assembly.

23 Claims, 8 Drawing Sheets

(56) References Cited

U.S. PATENT DOCUMENTS

| | | | | |
|---|---|---|---|---|
| 5,664,430 | A * | 9/1997 | Karman | F24F 13/22 62/285 |
| 5,787,721 | A | 8/1998 | Fromm | |
| 5,966,959 | A | 10/1999 | Stewart | |
| 6,112,536 | A | 9/2000 | Hansen | |
| 6,321,554 | B1 | 11/2001 | Rigoni | |
| 6,497,255 | B1 * | 12/2002 | Adams | F24F 13/02 138/108 |
| 6,523,363 | B1 | 2/2003 | Gully | |
| 6,901,766 | B1 | 6/2005 | Jin | |
| 7,370,489 | B2 | 5/2008 | Rios | |
| 7,418,826 | B2 | 9/2008 | Rios | |
| 7,430,877 | B2 * | 10/2008 | Davenport | F24F 13/224 62/272 |
| 8,061,156 | B2 | 11/2011 | Hayase | |
| 8,869,548 | B2 * | 10/2014 | Piccione | F24F 13/222 62/291 |
| 9,410,731 | B1 * | 8/2016 | Rowland | F25D 21/14 |
| 9,976,769 | B2 * | 5/2018 | Shinoda | F24F 13/222 |
| 2007/0169495 | A1 | 7/2007 | Thomas | |
| 2008/0184720 | A1 | 8/2008 | Morgan | |
| 2011/0232861 | A1 | 9/2011 | Stewart | |
| 2012/0151953 | A1 * | 6/2012 | Timbs | F24F 13/222 62/291 |
| 2014/0331698 | A1 | 11/2014 | Daley | |
| 2015/0153095 | A1 | 6/2015 | Mercer | |
| 2018/0003398 | A1 | 1/2018 | Sabbaghian | |

* cited by examiner

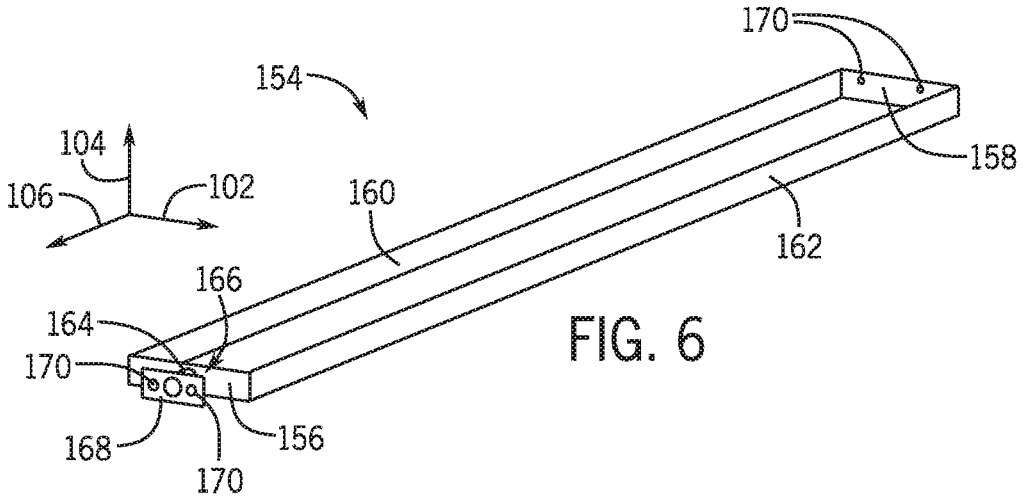
FIG. 6
FIG. 7
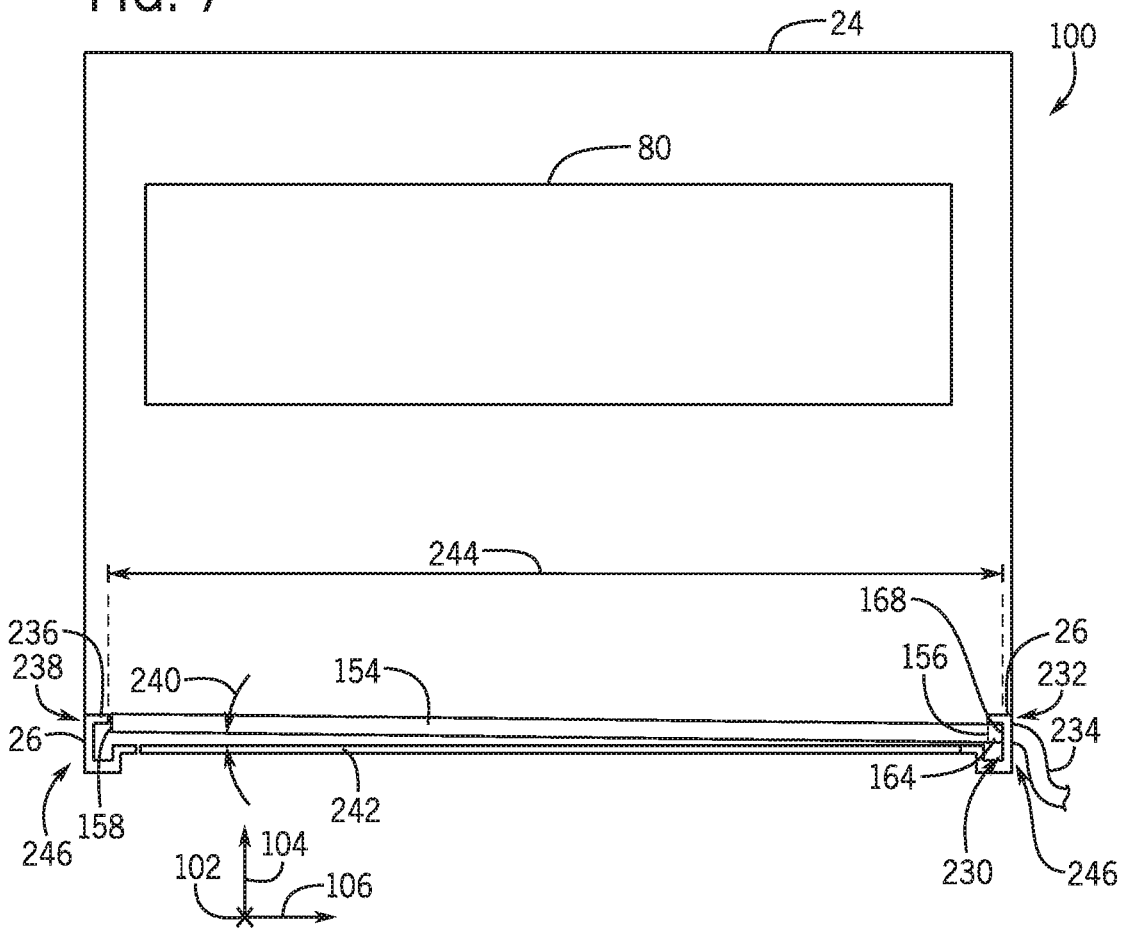

LIQUID DRAINAGE SYSTEMS AND METHODS

CROSS REFERENCE TO RELATED APPLICATIONS

This application claims priority from and the benefit of U.S. Provisional Application Ser. No. 62/713,315, entitled "LIQUID DRAINAGE SYSTEMS AND METHODS," filed Aug. 1, 2018, which is hereby incorporated by reference in its entirety for all purposes.

BACKGROUND

This disclosure relates generally to heating, ventilation, and air conditioning (HVAC) systems. Specifically, the present disclosure relates to a liquid drainage system for HVAC units.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and air conditioning (HVAC) system may be used to thermally regulate an environment, such as the interior of a building, home, or other structure. The HVAC system may include a vapor compression system, which includes heat exchangers, such as a condenser and an evaporator, which transfer thermal energy between the HVAC system and the environment. The HVAC system typically includes fans or blowers that direct a flow of supply air across a heat exchange area of the evaporator, such that refrigerant circulating through the evaporator may absorb thermal energy from the supply air. Accordingly, the evaporator may discharge conditioned air, which is subsequently directed toward a cooling load, such as the interior of the building. In many cases, the evaporator may condense moisture suspended within the supply air, such that a condensate is formed on an exterior surface of the evaporator. The condensate is generally directed to a drain pan of the HVAC system, which is configured to collect the condensate generated by the evaporator. In many cases, contaminants such as sludge, dust, or other particulates may accumulate within the drain pan over time, which may cause the drain pan to incur wear and performance degradation. Unfortunately, drain pans of conventional HVAC systems may be difficult to access and typically involve significant disassembly of the HVAC system to enable cleaning and/or replacement of the drain pan.

SUMMARY

The present disclosure relates to a liquid drainage system for a heating, ventilation, and/or air conditioning (HVAC) system, where the liquid drainage system includes a drain pan configured to collect and drain condensate within a housing. The drain pan is configured to be mounted within the housing separate from an evaporator assembly and is removable from the housing independent of the evaporator assembly. The liquid drainage system also includes a drain pan extension plate configured to collect and drain condensate to the drain pan, where the drain pan extension plate is configured be removably mounted within the housing. The drain pan extension plate and the drain pan are configured to overlap with one another, in an assembled configuration, along a direction of airflow across the evaporator assembly.

The present disclosure also relates to a liquid drainage system having a drain pan configured to be disposed beneath an evaporator assembly relative to gravity within a heating, ventilation, and/or air conditioning (HVAC) unit, where drain pan is configured to collect condensate generated by an evaporator of the evaporator assembly and is removable from the HVAC unit independent of the evaporator assembly. The liquid drainage system also includes a drain pan extension plate configured to be removably mounted within the HVAC unit, where the drain pan extension plate is configured to overlap with the drain pan in an assembled configuration, along a direction of airflow across the evaporator. The drain pan extension plate is configured to collect and drain condensate to the drain pan and is removable from the HVAC unit independent of the evaporator assembly and the drain pan.

The present disclosure also relates to liquid drainage system for a rooftop unit, where the liquid drainage system includes an evaporator assembly disposed within the rooftop unit and a drain pan disposed beneath the evaporator assembly relative to gravity. The drain pain is removably coupled to the rooftop unit and configured to collect and drain condensate within the rooftop unit. The liquid drainage system also includes a drain pan extension plate disposed within the rooftop unit and removably coupled to the rooftop unit. The drain pan extension plate overlaps with the drain pan in a direction of airflow across the evaporator assembly and is configured to collect and drain condensate to the drain pan.

BRIEF DESCRIPTION OF THE DRAWINGS

Various aspects of this disclosure may be better understood upon reading the following detailed description and upon reference to the drawings in which:

FIG. 6 is a perspective view of an embodiment of a drain pan included in the liquid drainage system of FIG. 5, in accordance with an aspect of the present disclosure;

FIG. 7 is a cross-sectional view of an embodiment of the liquid drainage system coupled to rails of an HVAC unit, in accordance with an aspect of the present disclosure;

DETAILED DESCRIPTION

Figure 1:
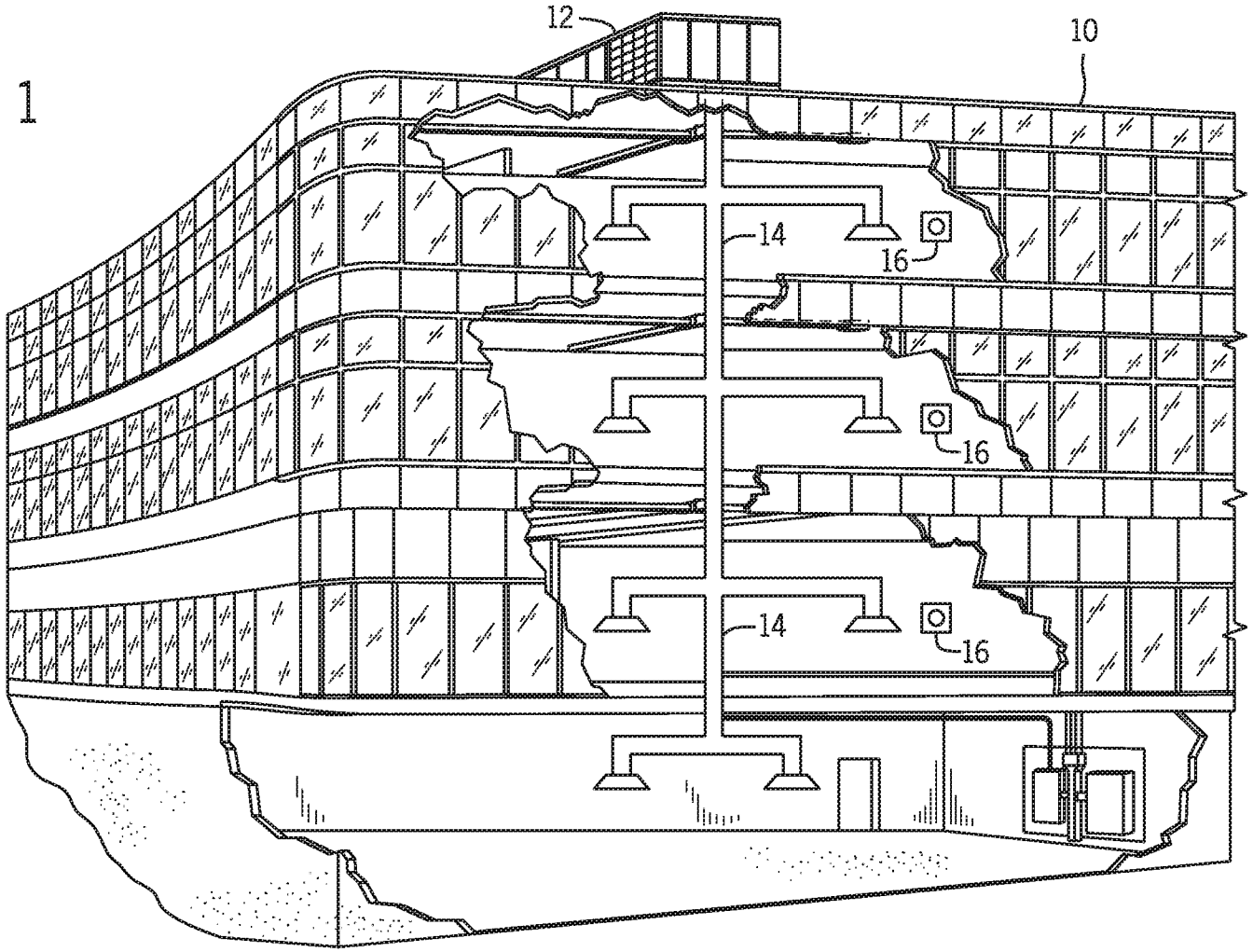
FIG. 1 is a perspective view of an embodiment of a building that may utilize a heating, ventilation, and air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A heating, ventilation, and air conditioning (HVAC) system may be used to thermally regulate a space within a building, home, or other suitable structure. For example, the HVAC system generally includes a vapor compression system that transfers thermal energy between a heat transfer fluid, such as a refrigerant, and a fluid to be conditioned, such as air. The vapor compression system includes a condenser and an evaporator that are fluidly coupled to one another via conduits. A compressor may be used to circulate the refrigerant through the conduits and enable the transfer of thermal energy between the condenser, the evaporator, and other fluid flows.

In many cases, the evaporator of the HVAC system may be used to condition a flow of air entering a building from an ambient environment, such as the atmosphere. For example, one or more fans of the HVAC system may direct a flow of supply air across a heat exchange area of the evaporator, such that the refrigerant within the evaporator absorbs thermal energy from the supply air. Accordingly, the evaporator cools the supply air before the supply air is directed into the building. In some cases, the refrigerant within the evaporator may absorb sufficient thermal energy to boil, such that the refrigerant exits the evaporator in a hot, gaseous phase. The compressor circulates the gaseous refrigerant toward the condenser, which may be used to remove the absorbed thermal energy from the refrigerant. For example, ambient air from the atmosphere may be drawn through a heat exchange area of the condenser, such that the gaseous refrigerant transfers thermal energy to the ambient air. In many cases, the condenser may enable the refrigerant to change phase, or condense, from the gaseous phase to the liquid phase, and the liquid refrigerant may be redirected toward the evaporator for reuse.

In certain cases, the evaporator may condense moisture suspended within the supply air, such that a condensate is formed. For example, the condensate may initially form and collect on the heat exchange area of the evaporator. The condensate typically flows along a height of the evaporator due to gravity, such that the condensate may discharge or drip from a lower end portion of the evaporator. A drain pan is disposed below the evaporator and is configured to collect the condensate generated during operation of the evaporator. As discussed above, certain contaminants may accumulate within the drain pan during operation of the HVAC system. For example, a stagnation of condensate within the drain pan may cause a collection of particulates or other matter within the drain pan and/or may cause the drain pan to corrode over time. In addition, dust, sludge, or other foreign matter may aggregate within the drain pan, such that cleaning and/or replacement of the drain pan is desired. Unfortunately, drain pans of conventional HVAC systems are often difficult to access, and significant disassembly of the HVAC system may be involved to clean and/or replace the drain pan. For example, in conventional HVAC systems, removal of the evaporator may be expected to enable sufficient access for a service technician to clean the drain pan or remove the drain pan from the HVAC system. Accordingly, maintenance operations on the drain pan may be time consuming and may therefore render the HVAC system inoperable for a significant period of time.

It is now recognized that maintenance operations on the drain pan may be facilitated and improved by enabling removal and/or replacement of the drain pan without disassembly and/or removal of other HVAC components adjacent the drain pan, such as the evaporator. Facilitating maintenance operations on the drain pan may reduce a time period between non-operational periods of the HVAC system, which may enhance an efficiency of the HVAC system.

Accordingly, embodiments of the present disclosure are directed to a liquid drainage system, also referred to herein as a drain pan assembly, which enables removal and/or replacement of the drain pan from the HVAC system without disassembly of an evaporator assembly of the HVAC system. The liquid drainage system includes a support frame, which may be coupled to base rails of a housing of the HVAC system. The support frame includes a support plate that, together with the support frame, is configured to support the evaporator assembly and maintain a position of the evaporator assembly relative to the housing of the HVAC system. The drain pan is disposed beneath the evaporator assembly, relative to gravity, such that the drain pan may collect condensate generated by the evaporator during operation of the HVAC system. The drain pan is coupled to the base rails, separate of the evaporator assembly, which enables removal of the drain pan independently of the evaporator assembly. In certain cases, the supply air flowing across the evaporator may be sufficient in force to dislodge condensate from the evaporator, such that the dislodged condensate is cast in a downstream direction, beyond the drain pan. Accordingly, the liquid drainage system includes a drain pan extension plate, which extends from the drain pan in the downstream direction and is configured to collect the condensate that may be cast from the evaporator by the supply air. The drain pan extension plate subsequently directs this condensate to the drain pan. The drain pan extension plate is coupled to the housing of the HVAC system, such that the drain pan extension plate is independently removable from the liquid drainage system.

As described in greater detail herein, removal of the drain pan extension plate may enable access to the drain pan, which facilitates performance of cleaning operations on the drain pan and/or removal of the drain pan from the HVAC system. The liquid drainage system also includes a base pan, which is disposed beneath the drain pan and the drain pan extension plate. In some embodiments, the drain pan is lowered into the base pan after the drain pan is decoupled from the base rails of the HVAC unit. Accordingly, the drain pan may be retracted from beneath the evaporator assembly by sliding the drain pan along a width of the base pan. The base pan may thus facilitate transitioning the drain pan from an assembled configuration, where the drain pan is coupled to the housing of the HVAC system, to a disassembled configuration, where the drain pan is decoupled and removed from the housing of the HVAC system. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
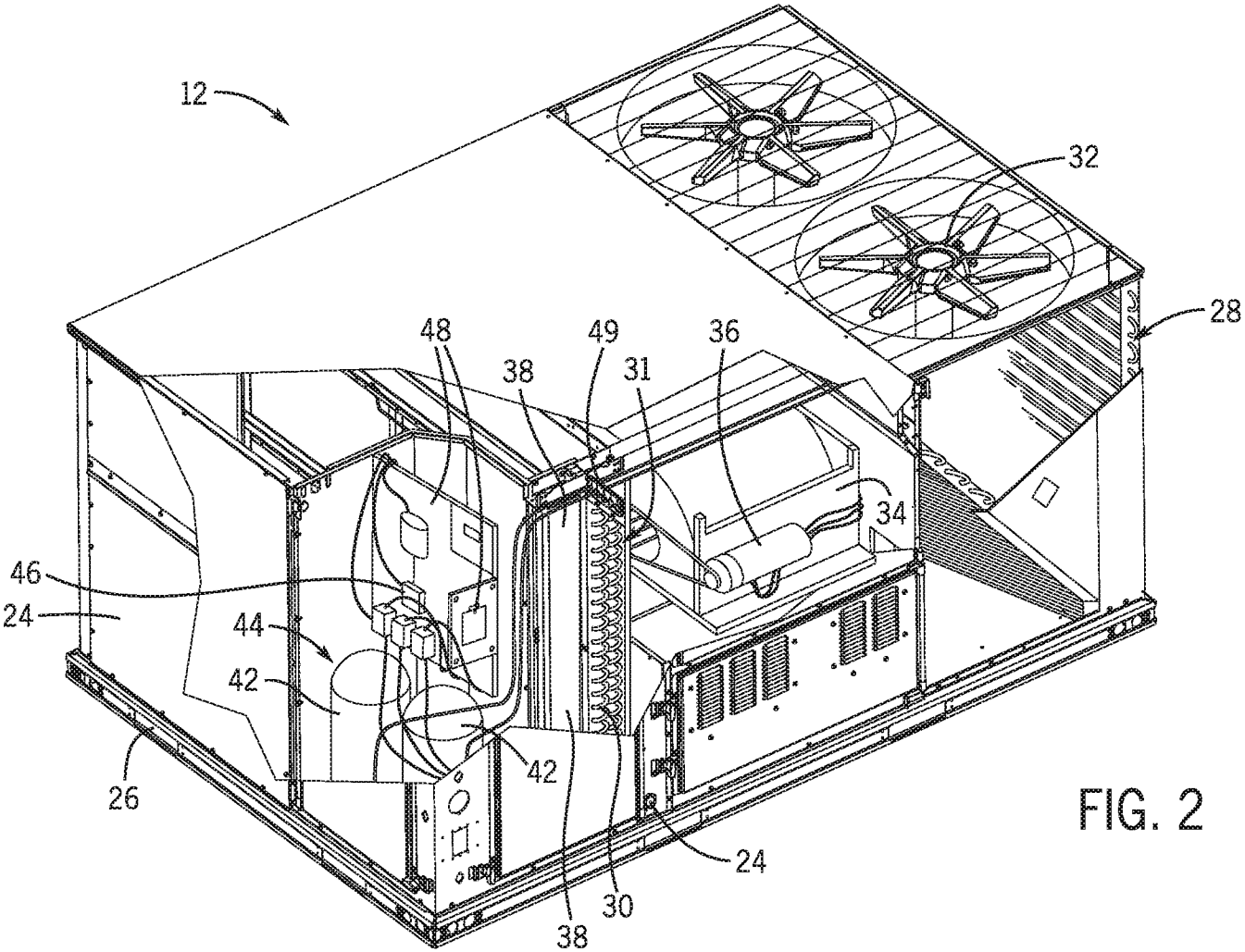
FIG. 2 is a perspective view of an embodiment of a packaged HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
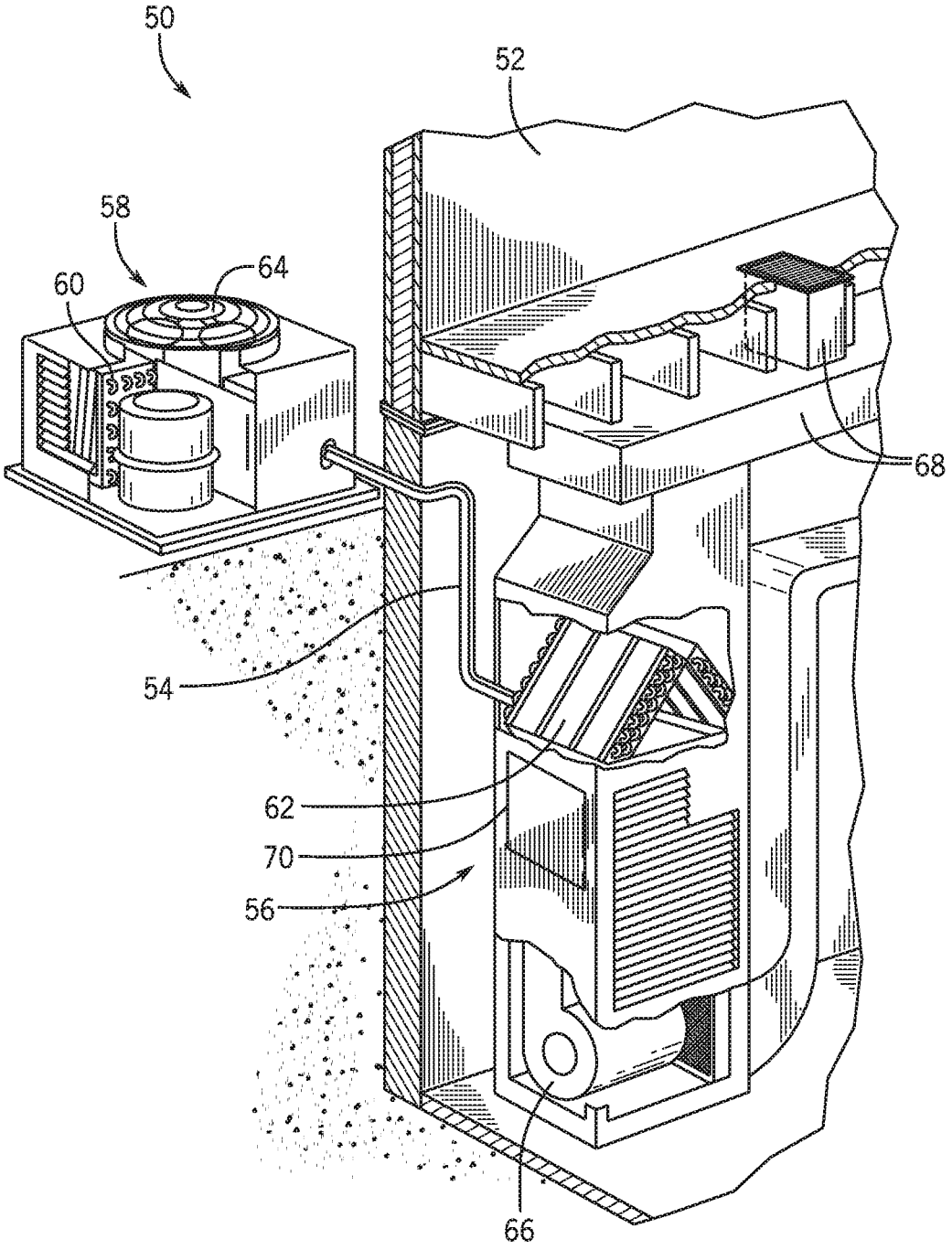
FIG. 3 is a perspective view of an embodiment of a residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
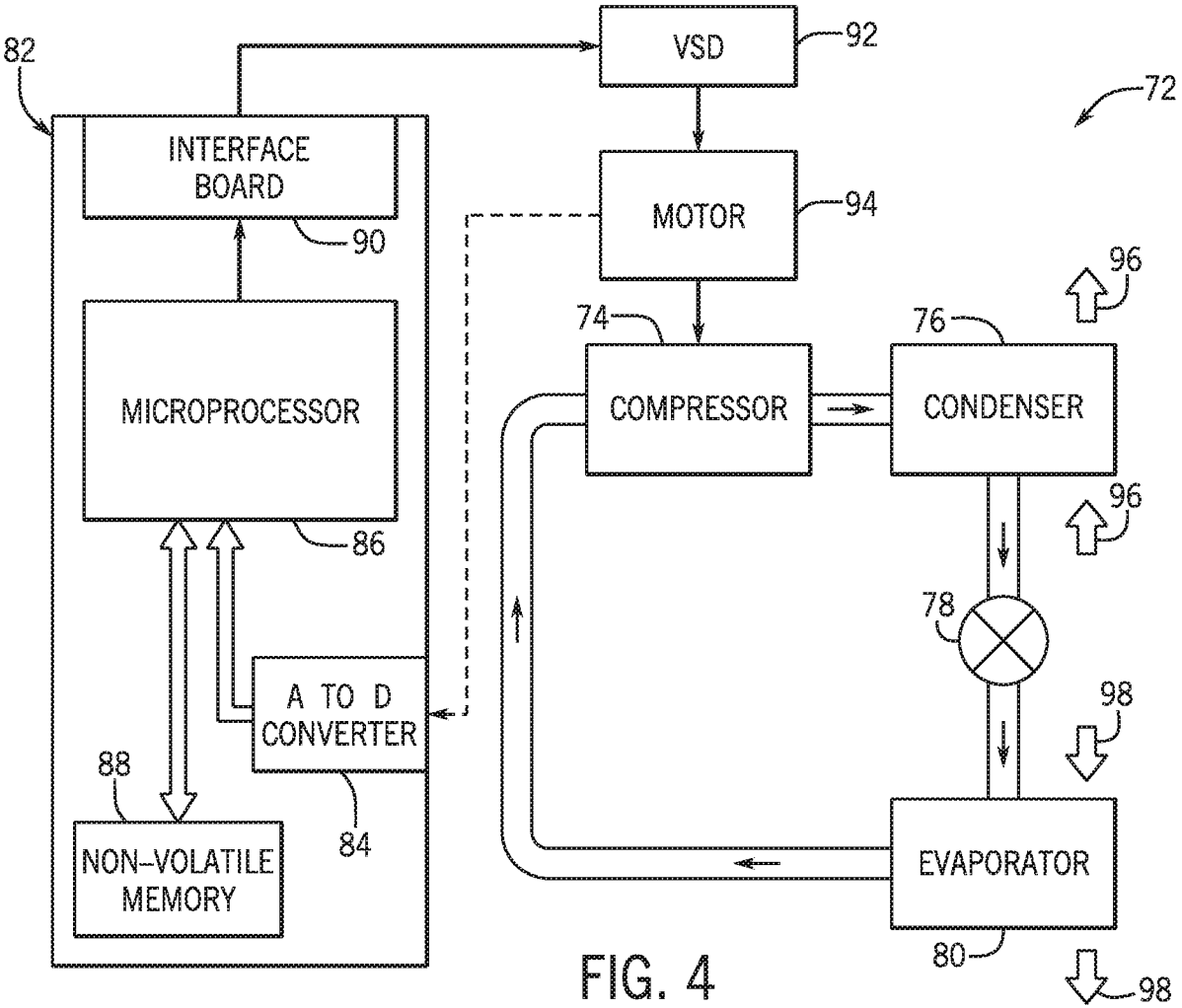
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or any other suitable HVAC systems. In some embodiments, the HVAC unit 12 is a designated heating system configured to operate in a heating mode and heat an air flow traversing through the HVAC unit 12. In other embodiments, the HVAC unit 12 may be a designated cooling system configured to operate in a cooling mode and cool, or condition, an air flow traversing through the HVAC unit 12. In yet further embodiments, the HVAC unit 12 may selectively transition between a heating mode or a cooling mode to heat or cool, respectively, an air flow traversing the HVAC unit 12. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
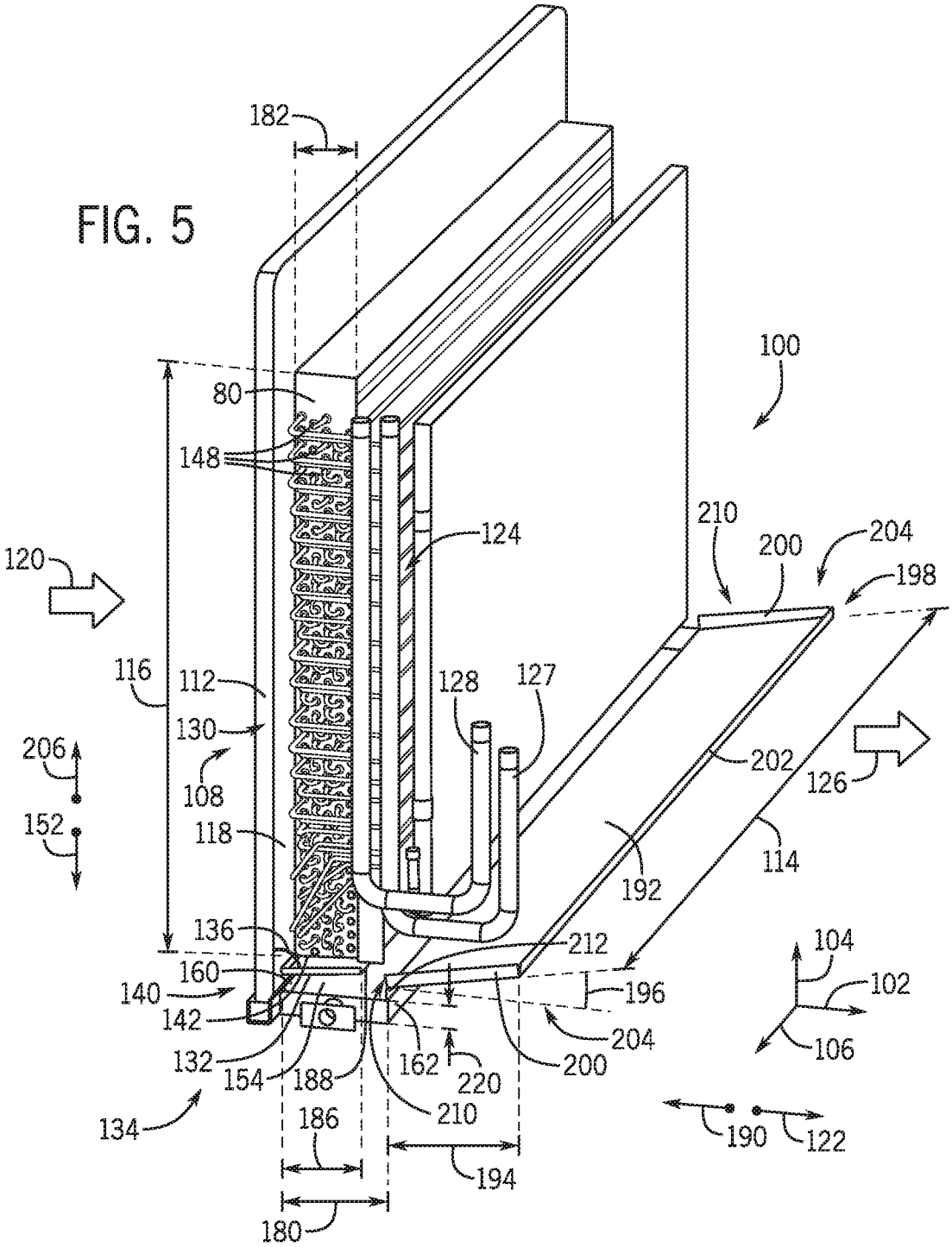
FIG. 5 is a perspective view of an embodiment of a liquid drainage system that may be included in an HVAC system, in accordance with an aspect of the present disclosure.

With the foregoing in mind, FIG. 5 illustrates a perspective view of an embodiment of a liquid drainage system 100, or a drain pan assembly, which may be included in embodiments or components of the HVAC unit 12 shown in FIG. 1. However, it should be noted that the liquid drainage system 100 may also be include in embodiments or components of the residential heating and cooling system 50 shown in FIG. 3, embodiments or components of a rooftop unit (RTU), or any other suitable HVAC system. To facilitate discussion, the liquid drainage system 100 and its components will be described with reference to a longitudinal axis or direction 102, a vertical axis or direction 104, and a lateral axis or direction 106. The liquid drainage system 100 includes an evaporator assembly 108 having an evaporator of the HVAC unit 12, such as the evaporator 80. The evaporator assembly 108 is coupled to a support frame 112 that is oriented along the vertical axis 104 and extends generally parallel to a length 114 of the evaporator 80. The evaporator 80 is coupled to the support frame 112 using fasteners, such a screws, bolts, rivets, crimp connections, or the like. Additionally or otherwise, the evaporator 80 may be coupled to the support frame 112 using an adhesive, such as bonding glue, welds, epoxy, or any other suitable adhesive. In any case, the support frame 112 may ensure that the length 114 of the evaporator 80 remains oriented substantially along the lateral axis 106, while a height 116 of the evaporator 80 remains oriented substantially along the vertical axis 104.

The support frame 112 may include an aperture, or a plurality of apertures, which are disposed within a backing plate 118 of the support frame 112. The aperture enables flow generating devices, such as one or more fans included in the blower assembly 34, to direct a flow of supply air 120 through the support frame 112 in a downstream direction 122. Accordingly, the supply air 120 may flow across a heat exchange area 124 of the evaporator 80, such that the evaporator 80 may discharge conditioned air 126 at a temperature less than a temperature of the supply air 120. For example, the vapor compression system 72 may circulate a refrigerant through the evaporator 80 via a supply line 127 and a return line 128 of the evaporator 80. The refrigerant circulating through the evaporator 80 may absorb thermal energy from the supply air 120, and thus, enable the evaporator 80 to discharge the supply air 120 as the conditioned air 126. Although the support frame 112 is disposed upstream of the evaporator 80 relative to a flow direction of the supply air 120 in the illustrative embodiment of FIG. 5, it should be noted that in other embodiments, the support frame 112 may be disposed downstream of the evaporator 80. As discussed in greater detail herein, the support frame 112 is coupled to the rails 26 of the cabinet 24, or a housing, of the HVAC unit 12. Accordingly, the support frame 112 may maintain a position of the evaporator assembly 108 within the cabinet 24.

In certain embodiments, the support frame 112 may engage with the cabinet 24 to block undesirable airflow between the cabinet 24 and the support frame 112. For example, a first outer surface 130 of the support frame 112, relative to a center of the evaporator assembly 108, may engage with a first side wall of the cabinet 24 and thereby block airflow between the first outer surface 130 and the side wall of the cabinet 24. Similarly, a second outer surface opposite the first outer surface 130, a top outer surface, and a bottom outer surface of the support frame 112 may engage with a second-side wall of the cabinet 24, a top panel of the cabinet 24, and a bottom panel of the cabinet 24, respectively. However, it should be appreciated that the support frame 112 may engage with any components of the cabinet 24 to block airflow therebetween. Accordingly, the support frame 112 may ensure that substantially all supply air 120 flowing through the HVAC unit 12 in the downstream direction 122 is directed through the aperture(s) of the support frame 112 and across the heat exchange area 124 of the evaporator 80. However, it should be noted that in certain embodiments, the support frame 112 may not engage directly with the cabinet 24. For example, one or more shrouds and/or gaskets may be disposed between the support frame 112 and the cabinet 24 to facilitate blocking of airflow between the support frame 112 and the cabinet 24.

As shown in the illustrated embodiment, the support frame 112 also includes a support plate 132, which extends from the support frame 112 in the downstream direction 122 near a bottom portion 134 of the support frame 112. In some embodiments, the support plate 132 may extend generally perpendicular to the support frame 112, such that an angle 136 between the support plate 132 and the support frame 112 is substantially equal to 90 degrees. However, as described in greater detail herein, the angle 136 between the support plate 132 and the support frame 112 may be less than 90 degrees or greater than 90 degrees, in certain embodiments of the liquid drainage system 100. In any case, the support plate 132 may support the evaporator 80 in addition to, or in lieu of, the support frame 112. For example, a lower portion 140 of the evaporator 80 may rest on the support plate 132 and couple to the support plate 132, such that the support plate 132 may support a weight or a portion of the weight of the evaporator 80. It is important to note that a gasket 142 may be disposed between the lower portion 140 of the evaporator 80 and the support plate 132 to block direct physical contact between the evaporator 80 and the support plate 132. Accordingly, the gasket 142 may mitigate or substantially eliminate corrosion between the evaporator 80 and the support plate 132.

For example, in some embodiments, the support plate 132 may be formed of steel or sheet metal, while the lower portion 140 of the evaporator 80, or the entire evaporator 80, is formed of aluminum. Direct physical contact between the steel or sheet metal support plate 132 and the aluminum lower portion 140 of the evaporator 80 may induce galvanic corrosion between the support plate 132 and the evaporator 80, which may cause the evaporator 80 to incur wear. Accordingly, the gasket 142 may preclude direct physical contact between the support plate 132 and the evaporator 80 and may thereby reduce or substantially eliminate a likelihood of corrosion between the evaporator 80 and the support plate 132. The gasket 142 may be formed of neoprene, cork, rubber, fiberglass, or any other suitable material to inhibit physical contact between the evaporator 80 and the support plate 132. In some embodiments, an additional gasket may be disposed between the backing plate 118 of the support frame 112 and the evaporator 80, which may ensure that the backing plate 118 is similarly precluded from direct physical contact between certain aluminum components of the evaporator 80. However, in other embodiments, the fasteners coupling the evaporator 80 to the support frame 112 may include spacers that enable a gap to remain between the evaporator 80 and the backing plate 118 after the evaporator 80 is coupled to the support frame 112 to block direct physical contact between the backing plate 118 and the evaporator 80. Further, it should be noted that in certain embodiments, the support frame 112, the backing plate 118, and the support plate 132 may each be constructed of aluminum. In such embodiments, the gasket 142 and/or the additional gasket may be omitted from the liquid drainage system 100.

In some embodiments, the evaporator 80 may dehumidify the supply air 120 flowing across the heat exchange area 124 of the evaporator 80. For example, the heat exchange area 124 of the evaporator 80 includes a plurality of channels 148 and/or a plurality of tubes, which collectively form a flow path through the evaporator 80 from the supply line 127 to the return line 128 of the evaporator 80. The refrigerant circulating through the flow path reduces a temperature of the channels 148, such that moisture within the supply air 120 may condense on an external surface of the channels 148. Accordingly, a condensate may form on the external surface of the channels 148, as the evaporator 80 dehumidifies the supply air 120 and discharges the conditioned air 126 at a humidity value lower than a humidity value of the supply air 120. The condensate may flow along the height 116 of the evaporator 80 in a downward direction 152 due to gravity and may drip off of the lower portion 140 of the evaporator 80.

As noted above, a drain pan 154 of the liquid drainage system 100 is disposed beneath the evaporator 80, relative to gravity, and is configured to collect the condensate generated during operation of the evaporator 80. Accordingly, condensate dripping from the lower portion 140 of the evaporator 80 is collected within the drain pan 154 to keep the condensate from accumulating or puddling elsewhere within the cabinet 24 of the HVAC unit 12. For clarity, a perspective view of an embodiment of the drain pan 154 is illustrated in FIG. 6. As shown in the illustrated embodiment, the drain pan 154 includes a first side wall 156, a second side wall 158, a first lateral wall 160, and a second lateral wall 162, which collectively encompass or defines a perimeter of the drain pan 154. A conduit 164 is coupled to an aperture 166 formed within the first side wall 156, to enable discharge of condensate collected within the drain pan 154. The drain pan 154 also includes a flange 168 that is coupled to the conduit 164. As described in greater detail herein, the second side wall 158 and the flange 168 enable the drain pan 154 to couple to the rails 26 the HVAC unit 12, independently of the evaporator assembly 108. For example, the second side wall 158 and the flange 168 each include mounting holes 170, which enable suitable fasteners to couple the second side wall 158 and the flange 168 to a respective one of the rails 26. Accordingly, the drain pan 154 may be coupled and decoupled from the HVAC unit 12 separately from the evaporator assembly 108. In this way, removal of the drain pan 154 from the HVAC unit 12 does not involve removal and/or disassembly of the evaporator assembly 108.

Returning now to FIG. 5, the drain pan 154 is disposed beneath the support plate 132 of the support frame 112, relative to the direction of gravity, in an assembled configuration of the liquid drainage system 100. In some embodiments, the first lateral wall 160 of the drain pan 154 may abut and physically contact the support frame 112 of the evaporator assembly 108. However, in other embodiments, a gap may be disposed between the first lateral wall 160 and the support frame 112. A width 180 of the drain pan 154 may be substantially equal to a width 182 of the evaporator 80 or may be greater than the width 182 of the evaporator 80. Accordingly, the drain pan 154 may function to collect condensate dripping from an upstream end and downstream end of the lower portion 140 of the evaporator 80 relative to the flow of air within the cabinet 24. However, as described in greater detail herein, the width 180 of the drain pan 154 may be less than the width 182 of the evaporator 80 in certain embodiments of the liquid drainage system 100.

As noted above, the angle 136 between the support plate 132 may be greater than 90 degrees, or less than 90 degrees in certain embodiments of the support frame 112. For example, in some embodiments, the support plate 132 may be angled toward the drain pan 154 in the downstream direction 122 to facilitate flow of condensate collected on the support plate 132 into the drain pan 154. In other words, the angle 136 between the support plate 132 and the support frame 112 may be greater than 90 degrees, such that the support plate 132 extends away from the evaporator 80 in the downstream direction 122. Accordingly, condensate dripping onto the support plate 132 from the evaporator 80 is directed along the support plate 132 in the downstream direction 122 and subsequently flows into the drain pan 154. It should be noted that, in such embodiments, the width 180 of the drain pan 154 may be greater than a width 186 of the support plate 132, such that the drain pan 154 may collect the condensate discharging from a tip 188 or downstream edge of the support plate 132.

In other embodiments, the angle 136 between the support plate 132 and the support frame 112 may be less than 90 degrees, such that condensate dripping onto the support plate 132 from the evaporator 80 is directed in an upstream direction 190 toward the backing plate 118 of the support frame 112. In such embodiments, one or more apertures may be disposed within the support plate 132 near the backing plate 118, such that condensate accumulating on the support plate 132 and near the backing plate 118 may flow through such apertures and collect within the drain pan 154 disposed therebeneath. Accordingly, the width 180 of the drain pan 154 may be equal to or greater than the width 186 of the support plate 132. However, in other embodiments, the width 180 of the drain pan 154 may be less than the width 186 of the support plate 132. In embodiments where the support plate 132 extends generally perpendicular to the support frame 112, the support plate 132 may include a plurality of apertures and/or perforations that extend along the width 186 and a length of the support plate 132 to enable condensate collected on the support plate 132 to flow through the support plate 132 and drip directly into the drain pan 154.

In some embodiments, the supply air 120 may flow across the evaporator 80 with sufficient force to dislodge a portion of the condensate that may accumulate on the external surface of the channels 148. Accordingly, the supply air 120 may cast this condensate from the evaporator 80 in the downstream direction 122 before the condensate falls from the evaporator 80, via gravity, in the downward direction 152 and into the drain pan 154. Such condensate may be ejected from the evaporator 80 in a generally parabolic trajectory, such that the ejected condensate is blown downstream of the drain pan 154. Accordingly, the liquid drainage system 100 includes a drain pan extension plate 192, which is disposed downstream of the drain pan 154 relative to the flow of air within the cabinet 24 and is configured to catch condensate that is cast from the channels 148 of the evaporator 80 via the supply air 120.

As shown in the illustrated embodiment, the drain pan extension plate 192 extends from the drain pan 154 in the downstream direction 122, such that condensate cast from the evaporator 80 may be collected by the drain pan extension plate 192. The drain pan extension plate 192 is angled toward the drain pan 154, such that condensate collected by the drain pan extension plate 192 is directed along a width 194 of the drain pan extension plate 192 and is subsequently discharged into the drain pan 154. In some embodiments, an angle 196 between the drain pan extension plate 192 and the width 180 of the drain pan 154 may be between about 10 degrees and 45 degrees. That is, an angle between the drain pan extension plate 192 and a substantially horizontal plane defined by the longitudinal axis 102 and the lateral axis 106 may be between about 10 degrees and about 45 degrees, between about 15 degrees and about 40 degrees, or between about 20 degrees and about 30 degrees. However, in other embodiments, the angle 196 between the drain pan extension plate 192 and the drain pan 154 may be less than 10 degrees or greater than 45 degrees. It should be noted that, in some embodiments, the angle 196 may be defined as extending between a base portion, or a bottom wall, of the cabinet 24 and the drain pan extension plate 192. That is, an angle between the drain pan extension plate 192 and the bottom wall of the cabinet 24 may be between about 10 degrees and about 45 degrees, between about 15 degrees and about 40 degrees, or between about 20 degrees and about 30 degrees.

A flow rate of the supply air 120 and/or a flow velocity of the supply air 120 across the evaporator 80 may affect a casting distance at which the supply air 120 may cast condensate from the channels 148 of the evaporator 80. For clarity, the term "casting distance" used herein referrers to a distance, measured along the longitudinal axis 102, at which the supply air 120 may carry a droplet of condensate from the evaporator 80 in the downstream direction 122 before the droplet of condensate is collected by the liquid drainage system 100 or contacts a floor of the cabinet 24. For example, a relatively large flow rate and/or a relatively large flow velocity the supply air 120 may enable the supply air 120 to cast the condensate from the evaporator 80 by a casting distance that is relatively large. Conversely, a relatively low flow rate and/or a relatively low flow velocity of the supply air 120 may cast condensate from the channels 148 at a casting distance that is relatively small. Accordingly, the width 194 of the drain pan extension plate 192 may be selected based on typical or expected flow rates and/or flow velocities at which the supply air 120 flows across the evaporator 80 during operation of the HVAC unit 12. For example, in certain embodiments, computer simulation tools, such as computation fluid dynamics software, may be used to determine the casting distance of condensate during operation of the HVAC unit 12. Additionally or otherwise, empirical trials may be used to determine the casting distance of the condensate from the evaporator 80. In some embodiments, the width 194 of the drain pan extension plate 192 may be adjusted based on a previously determined casting distance, such that a distance between the evaporator 80 and a downstream end portion 198 of the drain pan extension plate 192 is substantially equal to, or greater than a maximum calculated or determined casting distance of the condensate. Therefore, the drain pan extension plate 192 may be sized to ensure that substantially no condensate is blown past the drain pan extension plate 192 and onto another surface of the cabinet 24 during operation of the HVAC unit 12.

As shown in the illustrated embodiment of FIG. 5, the drain pan extension plate 192 includes a pair of side walls 200 and a downstream wall 202, which are configured to enable collection of condensate on the drain pan extension plate 192 and guidance of the condensate toward the drain pan 154. Accordingly, the pair of side walls 200 and the downstream wall 202 may block undesirable leakage of condensate near side portions 204 and the downstream end portion 198 of the drain pan extension plate 192, respectively. In some embodiments, the downstream wall 202 may include a plurality of apertures, which enable fasteners, such as screws, bolts, friction pins, or the like, to couple the drain pan extension plate 192 to a support structure disposed within the cabinet 24 or to a suitable portion of the cabinet 24 itself. A gasket may be disposed between the fasteners and the downstream wall 202 to block leakage of condensate through the apertures. In certain embodiments, a sealing material, such as silicone, may be used in addition to, or in lieu of, the gasket to block a flow of condensate through the apertures. As described in greater detail herein, it is important to note that the drain pan extension plate 192 does not couple directly to the drain pan 154 in the illustrated embodiment. Accordingly, the drain pan extension plate 192 may be removed from the liquid drainage system 100 and/or the cabinet 24 of the HVAC unit 12 independently of the drain pan 154 and without removal of the drain pan 154.

In some embodiments, the drain pan extension plate 192 may overlap with the drain pan 154 in the upstream direction 190 along the longitudinal axis 102. For example, a front end portion 210 of the drain pan extension plate 192 may extend past the second lateral wall 162 of the drain pan 154 in the upstream direction 190, such that the front end portion 210 of the drain pan extension plate 192 overlaps with the drain pan 154. This overlap may mitigate or substantially eliminate leakage of condensate between the drain pan extension plate 192 and the drain pan 154. As a non-limiting example, the drain pan extension plate 192 may overlap with the drain pan by 0.5 centimeters (cm), 1 cm, 2 cm, 3 cm, or more than 3 cm.

As shown in the illustrated embodiment, drain pan extension plate 192 also includes a flange 212 coupled to the front end portion 210 of the drain pan extension plate 192. In some embodiments, the flange 212 may extend from the drain pan extension plate 192 in a direction substantially opposite the downstream wall 202. For example, the downstream wall 202 of the drain pan extension plate 192 may extend from the drain pan extension plate 192 in an upward direction 206, while the flange 212 of the drain pan extension plate extends from the drain pan extension plate 192 the downward direction 152. In certain embodiments, the flange 212 of the drain pan extension plate 192 may further reduce a likelihood of condensate leakage between the drain pan extension plate 192 and the drain pan 154. For example, the flange 212 of the drain pan extension plate 192 may extend below a height 220 of the second lateral wall 162 of the drain pan 154, such that the flange 212 of the drain pan extension plate 192 overlaps with the second lateral wall 162 of the drain pan 154 relative to the vertical axis 104. That is, the flange 212 of the drain pan extension plate 192 overlaps with the second lateral wall 162 along a direction transverse to the direction of airflow across the evaporator assembly 108. This overlap may ensure that air flowing across the liquid drainage system 100 does not blow condensate discharging from the front end portion 210 between the drain pan 154 and the drain pan extension plate 192 before the condensate is able to flow from the front end portion 210 of the drain pan extension plate 192 into the drain pan 154.

FIG. 7 is a cross-sectional view of an embodiment of an HVAC unit, such as the HVAC unit 12, which illustrates the drain pan 154 in an assembled configuration. In the assembled configuration, the drain pan 154 is coupled to the rails 26 of the cabinet 24. For example, as shown in the illustrated embodiment, the flange 168 of the drain pan 154 is coupled to an inner surface 230 of a first rail 232 of the rails 26. An aperture may be disposed within the first rail 232 and configured to align with the conduit 164 when the drain pan 154 is in the assembled configuration. Accordingly, condensate within the drain pan 154 may drain from the HVAC unit 12 through the first rail 232 via the aperture. An additional conduit 234 may be coupled to the aperture, which is configured to direct the condensate from the HVAC unit 12 to a suitable fluid collection or drainage system separate from the HVAC unit 12. In some embodiments, a gasket may be disposed between the flange 168 and the inner surface 230 of the first rail 232 to provide a fluidic seal between the flange 168 and the inner surface 230.

The second side wall 158 of the drain pan 154 may be coupled to an upper flange 236 of a second rail 238 of the rails 26, which is disposed on a side of the HVAC unit 12 opposite the first rail 232. As shown in the illustrated embodiment, coupling the second-side wall 158 to the upper flange 236 of the second rail 238 enables the drain pan 154 to be disposed at an angle 240 relative to a lower surface or a base pan 242 of the HVAC unit 12. Accordingly, condensate collected within the drain pan 154 is directed along a length 244 of the drain pan 154 from the second side wall 158 toward the conduit 164, which mitigates a stagnation of condensate within the drain pan 154. As shown in the illustrated embodiment, the base pan 242 is disposed beneath the drain pan 154, relative to a direction of gravity. In some embodiments, the angle 240 between the drain pan 154 and the base pan 242 may be between about 1 degree and about 30 degrees, between about 5 degrees and about 25 degrees, or between about 10 degrees and about 20 degrees. Advantageously, this angled configuration may mitigate a likelihood of particulate accumulation that may occur when condensate is stagnant for extended periods of time. It should be noted that because the evaporator assembly 108 extends generally parallel to the base pan 242 or along the lateral axis 106, an angle between the drain pan 154 and the length 114 of the evaporator assembly 108 may be approximately equal to the angle 240 between the drain pan 154 and the base pan 242.

As discussed above, the drain pan 154 includes mounting holes 170 that are disposed within the flange 168 and the second-side wall 158 and are configured to receive fasteners, which facilitate coupling the drain pan 154 to the rails 26. In some embodiments, the fasteners may extend from an exterior surface 246 of each of the rails 26, through respective apertures within the rails 26, and may couple to the mounting holes 170 of the drain pan 154. Accordingly, an operator, such as a service technician, may access the fasteners from an exterior of the cabinet 24 to couple or decouple the drain pan 154 from the rails 26. This configuration may enable a service technician to quickly transition the drain pan 154 from the assembled configuration to a disassembled configuration during installation and removal of the drain pan 154 from the HVAC unit 12. As described in greater detail herein, the base pan 242 facilitates the transition of the drain pan 154 from the assembled configuration to the disassembled configuration. As a result, a time period during which the service technician removes the drain pan 154 from the HVAC unit 12 to perform maintenance operations on the drain pan 154 or replaces the drain pan 154 with another drain pan is further reduced.

Figure 8:
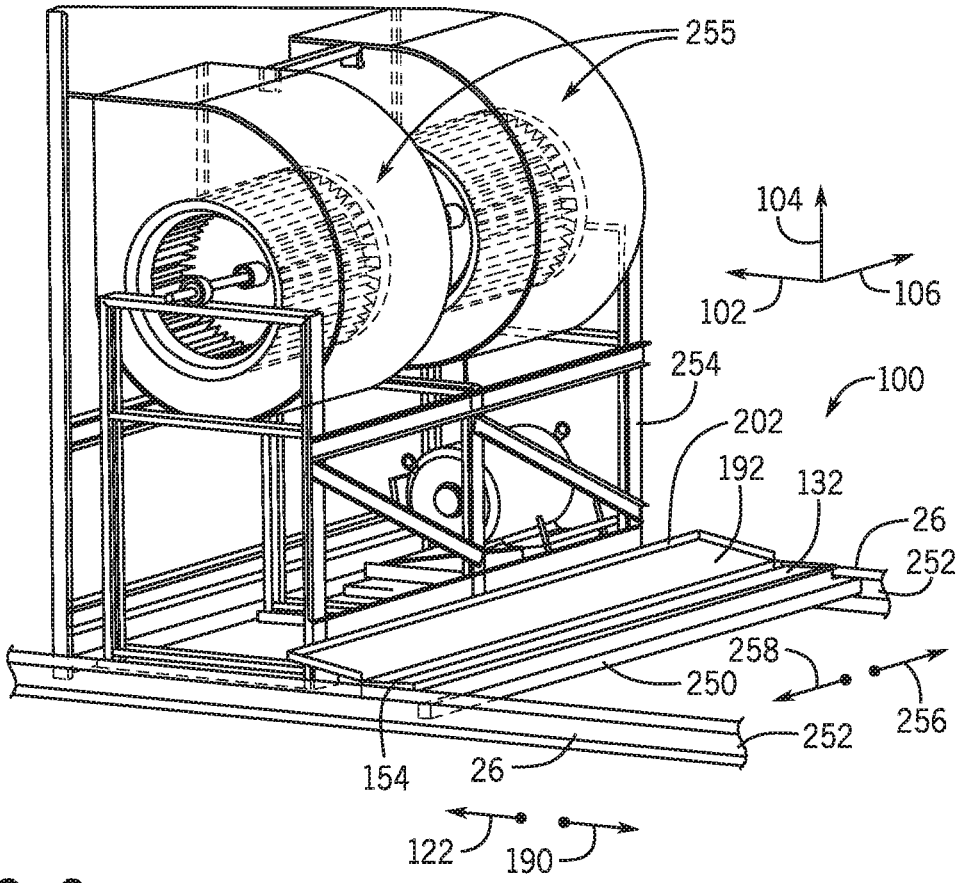
FIG. 8 is a perspective view of an embodiment of the liquid drainage system, in accordance with an aspect of the present disclosure.

FIG. 8 is a perspective view of an embodiment of the liquid drainage system 100, illustrating the liquid drainage system 100 in the assembled configuration. It should be noted that the evaporator assembly 108 and a portion of the support frame 112 have been removed in the illustrated embodiment to show features of the liquid drainage system 100 that may be disposed beneath the evaporator assembly 108 and the support frame 112. For example, FIG. 8 illustrates a cross-rail 250 of the support frame 112. The cross-rail 250 is coupled to the bottom portion 134 of the support frame 112 and engages with grooves 252 disposed within each of the rails 26. Accordingly, the grooves 252 may support the cross-rail 250 and the support frame 112 coupled to the cross-rail 250. For example, suitable fasteners such as screws, bolts, dowel pins, or the like, may be used to couple to the cross-rail 250 to rails 26 of the HVAC unit 12.

Although the cross-rail 250 is shown as a separate component of the support frame 112 in the illustrated embodiment, it should be noted that, in other embodiments, the cross-rail 250 may be integrally formed with the support frame 112.

As shown in the illustrated embodiment, the downstream wall 202 of drain pan extension plate 192 is coupled to a frame assembly 254 of the cabinet 24, which supports one or more fans or blowers 255 of the HVAC unit 12. However, in other embodiments, the downstream wall 202 may couple to any other internal frame, structure, or component disposed within the cabinet 24 in addition to, or in lieu of, the frame assembly 254. For clarity, it should be noted that side panels of the cabinet 24 have been removed in the illustrated embodiment to show the liquid drainage system 100 disposed within the cabin 24. As discussed in greater detail below, the side panels of the cabinet 24 may include one or more access panels or access doors than enable a service technician to obtain access to an interior of the cabinet 24. Accordingly, the access panel(s) may enable the service technician to remove the drain pan extension plate 192 and/or the drain pan 154 from the interior of the cabinet 24.

For example, the drain pan extension plate 192 may be removed from the HVAC unit 12 by removing the fasteners coupling the downstream wall 202 of the drain pan extension plate 192 to the frame assembly 254 of the cabinet 24. After the fasteners are removed, the drain pan extension plate 192 may be removed from the HVAC unit 12 by translating the drain pan extension plate 192 along a first lateral direction 256 or along a second lateral direction 258 relative to the cabinet 24. That is, the drain pan extension plate 192 may be removed from the cabinet 24 by translating the drain pan extension plate 192 in the first lateral direction 256 or the second lateral direction 258 through a corresponding access panel disposed with a side wall of the cabinet 24. Accordingly, the drain pan extension plate 192 may be removed from the HVAC unit 12 independently of other components of the liquid drainage system 100, such as the drain pan 154 and the evaporator assembly 108. As described in greater detail below, removal of the drain pan extension plate 192 may enable access to the drain pan 154, such that the drain pan 154 may be decoupled from the liquid drainage system 100 and removed from the HVAC unit 12. As mentioned above, the drain pan 154 may be removed independently of the remaining components of the liquid drainage system 100, such as the evaporator assembly 108. Although the drain pan extension plate 192 is shown as coupled to the frame assembly 254 in the illustrated embodiment of FIG. 8, it should be noted that the drain pan extension plate 192 may couple to any other suitable portion or portions of the cabinet 24 in other embodiments of the HVAC unit 12.

Figure 9:
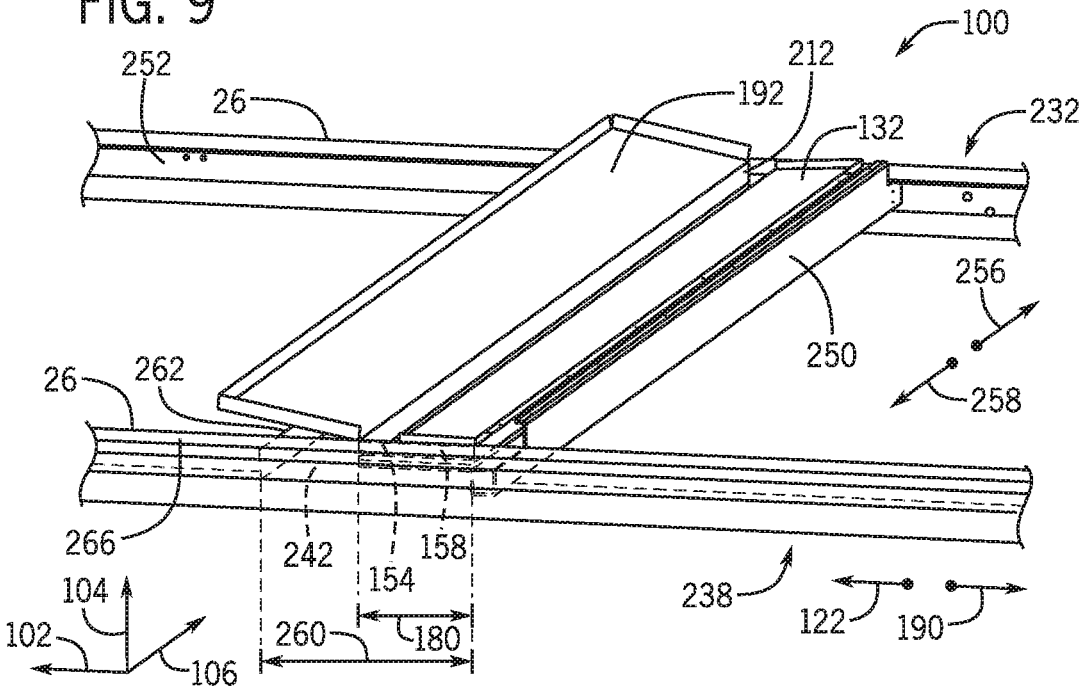
FIG. 9 is a perspective view of an embodiment of the liquid drainage system of FIG. 8, in accordance with an aspect of the present disclosure.

FIG. 9 is a perspective view of an embodiment of the liquid drainage system 100. The base pan 242 is coupled to the rails 26 of the cabinet 24 using suitable fasteners, and forms a lower portion of the liquid drainage system 100. In some embodiments, the base pan 242 may abut the cross-rail 250 of the support frame 112. However, in other embodiments, a gap may be disposed between the base pan 242 and the cross-rail 250. As noted above, the base pan 242 may facilitate transitioning the liquid drainage system 100 from an assembled configuration, in which both the drain pan extension plate 192 and the drain pan 154 are installed in the HVAC unit 12, and a disassembled configuration, in which the drain pan extension plate 192 and the drain pan 154 are removed from the HVAC unit 12.

For example, after decoupling and removing the drain pan extension plate 192 from the HVAC unit 12 in accordance with the procedure described above, the drain pan 154 may subsequently be decoupled from the rails 26 and lowered into the base pan 242. After lowering the drain pan 154 into the base pan 242, the drain pan 154 may be translated along a width 260 of the base pan 242 in the downstream direction 122 and toward a back wall 262 of the base pan 242. It is important to note that the width 260 of the base pan 242 is selected such that translation of the drain pan 154 to the back wall 262 sufficiently uncovers the drain pan 154 from certain components of the liquid drainage system 100 disposed above the drain pan 154, such as the support plate 132. In other words, when the drain pan 154 is transitioned to a position against the back wall 262 of the base pan 242, the drain pan 154 is not obstructed by components that may inhibit lifting of the drain pan 154 for removal from the HVAC unit 12. For example, the width 260 of the base pan 242 may be approximately twice the width 180 of the drain pan 154, approximately triple the width 180 of the drain pan 154, or more than approximately triple the width 180 of the drain pan 154. Accordingly, the base pan 242 enables the drain pan 154 to translate a sufficient distance from the evaporator assembly 108 in the downstream direction 122, such that the evaporator assembly 108 does not hinder removal of the drain pan 154 from the HVAC unit 12. To remove the drain pan 154 from the liquid drainage system 100, the second-side wall 158 of the drain pan 154 may be raised above a top surface 266 of the second rail 238. Accordingly, the drain pan 154 may be removed from the HVAC unit 12 by translating the drain pan 154 in the second lateral direction 258. In this way, a service technician may perform maintenance operations or the drain pan 154, such as cleaning the drain pan 154 and/or removing contaminants from the drain pan 154, or may replace the drain pan 154 with another drain pan.

Figure 10:
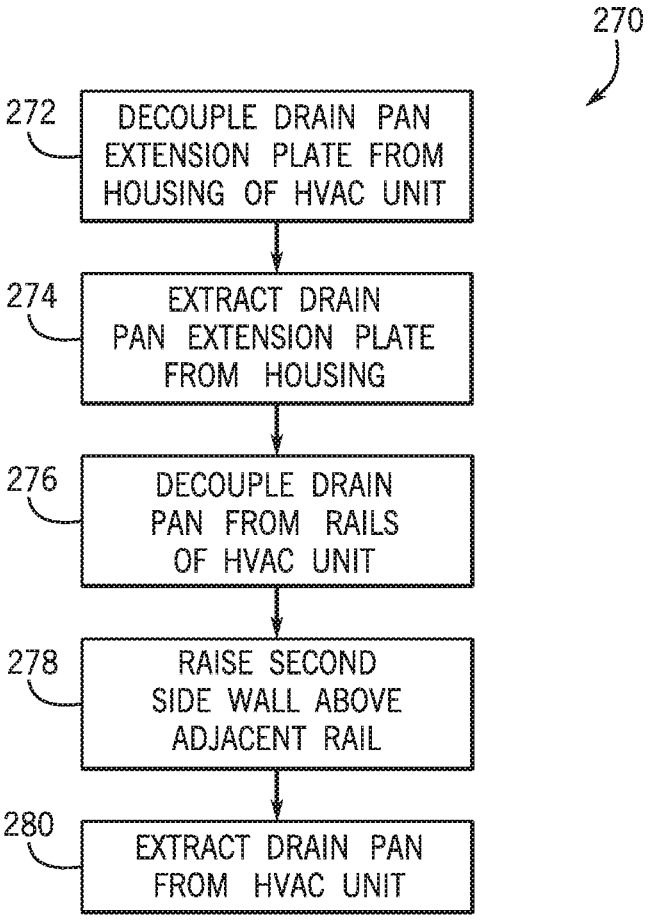
FIG. 10 is an embodiment of a method of transitioning the liquid drainage system between an assembled configuration and a disassembled configuration.

With the foregoing in mind, FIG. 10 is block diagram of an embodiment of a method 270 of transitioning the liquid drainage system 100 between the assembled configuration and the disassembled configuration. The following discussion references element number used throughout the discussion of FIGS. 1-9. The method 270 begins with decoupling the drain pan extension plate 192 from a support structure disposed within the cabinet 24 of the HVAC unit 12, such as the frame assembly 254, as indicated by process block 272. An operator, such as the service technician, may subsequently remove the drain pan extension plate 192 from the HVAC unit 12 by translating the drain pan extension plate 192 relative to the HVAC unit 12 along the first lateral direction 256 or the second lateral direction 258, as indicated by process block 274. It should be noted that the HVAC unit 12 may include an access panel and/or an access door disposed within a side wall of the cabinet 24 and adjacent the liquid drainage system 100, which enables the service technician to access the drain pan extension plate 192, decouple the drain pan extension plate 192 from the HVAC unit 12, and remove the drain pan extension plate 192 from the cabinet 24.

The service technician may subsequently decouple the drain pan 154 from the rails 26 of the HVAC unit 12, as indicated by process block 276. The service technician may slide the drain pan 154 along the base pan 242 in the downstream direction 122 toward the back wall 262 of the base pan 242, such that the drain pan 154 is not obstructed from above by the evaporator assembly 108 of the HVAC unit 12. In some embodiments, translating the drain pan 154 to the back wall 262 exposes the drain pan 154 from other components of the HVAC unit 12, such as the evaporator assembly 108, by a sufficient distance to enable the service technical to clean the drain pan 154 and/or remove foreign matter from the drain pan 154. Accordingly, the service technician may perform maintenance operations on the drain pan 154 while the drain pan 154 is unfastened from the HVAC unit 12 but still disposed within the cabinet 24 of the HVAC unit 12.

It other embodiments, the service technician may remove the drain pan 154 from the cabinet 24 to perform the maintenance operations. In such embodiments, the service technician may raise the second side wall 158 of the drain pan 154 above the top surface 266 of the second rail 238, as indicated by process block 278. The service technician may subsequently remove the drain pan 154 from the HVAC unit 12 by translating the drain pan 154 in the second lateral direction 258. For example, the service technician may extract the drain pan 154 from the cabinet 24 via the same access panel or access door as the drain pan extension plate 192, or via a separate access panel and/or a separate access door.

It should be noted that the liquid drainage system 100 may be transitioned from the disassembled configuration to the assembled configuration in the reverse order discussed above. For example, the service technician may first insert the drain pan 154 into the cabinet 24 by translating the drain pan 154 through the designated access panel and/or access door in the first lateral direction 256. The service technical may subsequently lower the drain pan 154 into the base pan 242 and translate the drain pan 154 along the base pan 242 in the upstream direction 190. The service technician may then fasten the drain pan 154 to the rails 26 of the HVAC unit 12. The service technician may subsequently insert the drain pan extension plate 192 into the cabinet 24 in the first lateral direction 256 or the second lateral direction 258 and then couple the drain pan extension plate 192 to a suitable portion of the cabinet 24.

Technical effects of the liquid drainage system 100 include improved access to the drain pan 154 by enabling removal of the drain pan 154 without removal and/or disassembly of the evaporator assembly 108. Accordingly, the configuration of the liquid drainage system 100 may reduce a time period during which a service technician performs maintenance operations on the drain pan 154, such as when the service technician removes contaminants from the drain pan 154 or replaces the drain pan 154 with another drain pan. Therefore, the liquid drainage system 100 may reduce a lapse of time between operational periods of the HVAC system throughout which the maintenance operations on the drain pan 154 are performed, which may increase an efficiency of the HVAC system.

As discussed above, the aforementioned embodiments of the liquid drainage system 100 may be used on the HVAC unit 12, the residential heating and cooling system 50, a rooftop unit, or in any other suitable HVAC system. Additionally, the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A heating, ventilation, and/or air conditioning (HVAC) system, comprising:

a rooftop unit comprising a housing and base rails;

a drain pan configured to collect and drain condensate within the housing, wherein the drain pan is configured to be mounted within the housing separately from an evaporator assembly, and wherein the drain pan is removable from the housing independently of the evaporator assembly;

a drain pan extension plate configured to collect and drain condensate to the drain pan, wherein the drain pan extension plate is configured to be removably mounted within the housing; and a base pan configured to be disposed beneath the drain pan relative to gravity and configured to be coupled to the base rails, wherein the base pan is configured to receive the drain pan and enable translation of the drain pan within the base pan during installation and removal of the drain pan from the HVAC system, wherein the drain pan extension plate and the drain pan are configured to overlap with one another, in an assembled configuration, along a direction of airflow across the evaporator assembly, and wherein the drain pan extension plate is downstream of the evaporator assembly along the direction of airflow across the evaporator assembly.

2. The HVAC system of claim 1, wherein a first width dimension of the base pan in the direction of airflow across the evaporator assembly is at least twice a second width dimension of the drain pan in the direction of airflow across the evaporator assembly, and wherein a first length dimension of the base pan spans along a second length dimension of the drain pan.

3. The liquid drainage HVAC system of claim 1, comprising:

a support frame disposed within the housing, the support frame configured to support the evaporator assembly; and an evaporator support plate coupled to the support frame, wherein the evaporator support plate is disposed beneath the evaporator assembly and above the drain pan relative to gravity in the assembled configuration.

4. The HVAC system of claim 1, wherein the drain pan is configured to be coupled to the base rails, wherein the base rails extend along the direction of airflow across the evaporator assembly.

5. The HVAC system of claim 1, wherein the drain pan extension plate is configured to be disposed at an angle relative to a dimension of the drain pan along the direction of airflow across the evaporator assembly.

6. The HVAC system of claim 1, wherein the drain pan extension plate comprises a pair of side walls and a downstream wall extending between the pair of sidewalls, wherein the downstream wall defines a downstream end portion of the drain pan extension plate and is configured to be removably coupled to a support frame within the housing.

7. The HVAC system of claim 6, comprising a flange extending from the drain pan extension plate, wherein the flange is configured to overlap with a wall of the drain pan along a second direction transverse to the direction of airflow in the assembled configuration, and wherein the flange defines an upstream end portion of the drain pan extension plate.

8. A liquid drainage system, comprising:

a drain pan configured to be disposed beneath an evaporator assembly relative to gravity within a heating, ventilation, and/or air conditioning (HVAC) unit, wherein the drain pan is configured to collect condensate generated by an evaporator of the evaporator assembly, and the drain pan is removable from the HVAC unit independently of the evaporator assembly;

a drain pan extension plate configured to be removably mounted within the HVAC unit, wherein the drain pan extension plate is configured to overlap with the drain pan in an assembled configuration, along a direction of airflow across the evaporator, wherein the drain pan extension plate is configured to collect and drain condensate to the drain pan, and wherein the drain pan extension plate is removable from the HVAC unit independently of the evaporator assembly and the drain pan; and a base pan configured to be disposed beneath the drain pan relative to gravity and configured to be coupled to base rails of the HVAC unit, wherein the base pan is configured to receive the drain pan and enable translation of the drain pan within the base pan during installation and removal of the drain pan from the HVAC unit.

9. The liquid drainage system of claim 8, wherein the drain pan is configured to couple to the base rails of the HVAC unit, and wherein the drain pan is configured to extend between the base rails at an angle relative to the base pan of the HVAC unit.

10. The liquid drainage system of claim 8, wherein a downstream wall of the drain pan extension plate is configured to removably couple to an internal frame of the HVAC unit, and wherein the drain pan extension plate is configured to extend from the internal frame to the drain pan at an angle relative to the direction of airflow across the evaporator.

11. The liquid drainage system of claim 8, comprising:

a support frame configured to couple to the base rails of the HVAC unit, wherein the evaporator assembly is configured to couple to the support frame; and a support plate configured to extend from the support frame in the direction of airflow across the evaporator, wherein the support plate is configured to be disposed beneath the evaporator assembly relative to gravity within the HVAC unit and is configured to support the evaporator assembly.

12. The liquid drainage system of claim 11, wherein the support plate is configured to be disposed above the drain pan relative to gravity within the HVAC unit.

13. The liquid drainage system of claim 11, comprising a gasket configured to be disposed between the evaporator assembly and the support plate.

14. The liquid drainage system of claim 11, wherein the support plate is configured to diverge toward the evaporator assembly in the direction of airflow across the evaporator.

15. The liquid drainage system of claim 8, wherein a first dimension of the base pan in the direction of airflow across the evaporator is at least twice a second dimension of the drain pan in the direction of airflow across the evaporator.

16. The liquid drainage system of claim 15, wherein the second dimension of the drain pan exceeds a third dimension of the evaporator in the direction of airflow across the evaporator.

17. The liquid drainage system of claim 8, wherein the HVAC unit is a rooftop unit.

18. A rooftop unit, comprising:

a base rail;

an evaporator assembly disposed within the rooftop unit;

a drain pan disposed beneath the evaporator assembly relative to gravity and removably coupled to the rooftop unit, wherein the drain pan is configured to collect and drain condensate within the rooftop unit;

a drain pan extension plate disposed within the rooftop unit and removably coupled to the rooftop unit independently of the evaporator assembly, wherein the drain pan extension plate overlaps with the drain pan along a direction of airflow across the evaporator assembly, and wherein the drain pan extension plate is configured to collect and drain condensate to the drain pan; and a base pan configured to be disposed beneath the drain pan relative to gravity and configured to be coupled to the base rail, wherein the base pan is configured to receive the drain pan and enable translation of the drain pan within the base pan during installation and removal of the drain pan from the rooftop unit.

19. The rooftop unit of claim 18, comprising a support frame coupled to the base rail of the rooftop unit, wherein the support frame comprises a support plate configured to support the evaporator assembly, and wherein the support plates extends from the support frame in the direction of airflow across the evaporator assembly.

20. The rooftop unit of claim 19, wherein a first dimension of the drain pan in the direction of airflow across the evaporator assembly is greater than a second dimension of the support plate in the direction of airflow across the evaporator assembly.

21. The rooftop unit of claim 18, wherein the drain pan comprises a conduit coupled to an aperture disposed on a first side wall of the drain pan, wherein the conduit comprises a flange configured to be coupled to the base rail of the rooftop unit.

22. The rooftop unit of claim 21, wherein the drain pan comprises a second side wall, opposite the first side wall, and wherein the second side wall is configured to be coupled to an additional base rail of the rooftop unit.

23. The rooftop unit of claim 18, wherein a first dimension of the base pan in the direction of airflow across the evaporator assembly is at least twice a second dimension of the drain pan in the direction of airflow across the evaporator assembly.

* * * * *